United States Patent [19]

Pellegrini

[11] 4,361,407

[45] Nov. 30, 1982

[54] STATIONARY MIXER DEVICE ARRANGED TO HOMOGENEOUSLY MIX TWO OR MORE COMPONENTS IN LIQUID OR SEMILIQUID STATE

[75] Inventor: Vittorio Pellegrini, Novara, Italy

[73] Assignee: Centro Ricerche Fiat S.p.A., Orbassano, Italy

[21] Appl. No.: 275,680

[22] Filed: Jun. 22, 1981

[30] Foreign Application Priority Data

Jun. 27, 1980 [IT] Italy ..... 68009 A/80

[51] Int. Cl.[3] ..... B01F 5/06

[52] U.S. Cl. ..... 366/340; 422/133; 422/135; 422/224

[58] Field of Search ..... 366/336, 337, 340, 338, 366/339; 138/38, 42; 48/180 R, 180 F, 180 B; 422/133, 135, 224

[56] References Cited

U.S. PATENT DOCUMENTS 3,623,704 11/1971 Skobel ..... 366/337
3,701,619 10/1972 Appeldoorn ..... 366/336
4,087,862 5/1978 Tsien ..... 366/340
4,124,309 11/1978 Yao ..... 366/340
4,222,671 9/1980 Gilmore ..... 366/337

*Primary Examiner*—Robert W. Jenkins
*Attorney, Agent, or Firm*—Frost & Jacobs

[57] ABSTRACT

The device comprises a plurality of superimposable elements, in each of which there are formed cavities and holes arranged to originate channels for conveying the components, the said channels being disposed so as to originate a plurality of channel assemblies disposed in series to each other, each assembly comprising a first central channel, second channels with axes are substantially orthogonal to the axis of the said first channel, which second channels communicate with this latter and are disposed radially with respect to it, third channels, each of which has its axis parallel to that of the said first channel and originates from a corresponding second channel, and fourth channels whose axes are substantially orthogonal to the axis of the said first channels and which are disposed radially with respect to it.

6 Claims, 6 Drawing Figures

STATIONARY MIXER DEVICE ARRANGED TO HOMOGENEOUSLY MIX TWO OR MORE COMPONENTS IN LIQUID OR SEMILIQUID STATE

BACKGROUND OF THE INVENTION

The present invention relates to a mixer device arranged to homogeneously mix two or more components in liquid or semiliquid state, particularly the components of a mixture comprising a solid phase and a liquid phase of a metal alloy of the type of those which are utilized in the so-called "semiliquid molding processes".

SUMMARY OF THE INVENTION

A first object of the present invention is to provide a device of the type mentioned hereinabove, which, though being structurally very simple, will allow to rapidly mix a plurality of components with a high degree of mixing.

Another object of the present invention is to provide a device of the type mention hereinabove, in which the mixing degree will be easily and rapidly variable by adding or eliminating some elements of the device in order to adapt it to any mixing requirement.

A further object of the present invention is to provide an easily and safely usable device which, thus, will allow both a rapid and safe cleaning of its parts traversed by the material, and an immediate substitution of the worn or damaged elements.

Finally, a further object of the present invention is to provide a mixer device which will allow obtaining a desired thermal gradient in the material which moves along the device, in order to rigorously control the characteristics of the material, in particular the ratio between the concentrations of the liquid and solid phases of a metal alloy, which ratio is affected by the said thermal gradient.

The mixer device according to the present invention is characterized in comprising a plurality of superimposable elements, in each of which there are formed cavities and holes arranged to give rise to channels for conveying the said components, the said channels being disposed in such a manner as to originate a plurality of channel assemblies disposed in series to each other, each assembly comprising a first central channel, second channels whose axes are substantially orthogonal to that of the said first channel and which communicate with the said first channel and are disposed radially relative to it, third channels each of which has its axis parallel to that of the said first channel and originates from a corresponding second channel, and fourth channels whose axes are substantially orthogonal to the axis of the said first channel and which are disposed radially with respect to it, each of the said fourth channels being in communication with one of the said third channels and with the first channel of an adjacent assembly.

BRIEF DESCRIPTION OF THE DRAWINGS

For a better understanding of the present invention an embodiment thereof will now be described, by way of non limiting example, with reference to the annexed drawings, in which.

DETAILED DESCRIPTION OF THE INVENTION

The device according to the present invention comprises substantially a plurality of superimposable elements, on each of which there are formed cavities and holes arranged to originate channels for conveying the liquid or semiliquid components to be intimately mixed with each other.

Figure 5:
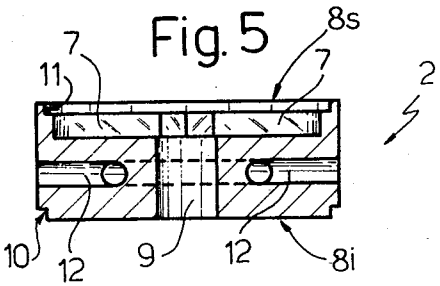
FIGS. 4 and 5 are, respectively, a plan view and a section along line V—V, of a second superimposable element which is part of the device.
Figure 4:
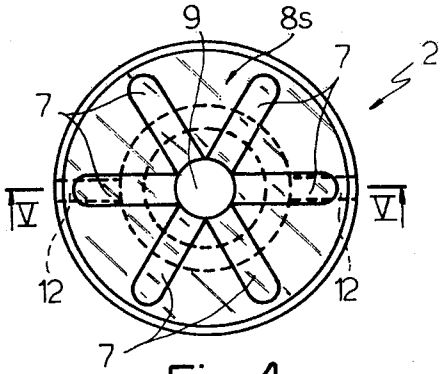
Figure 3:
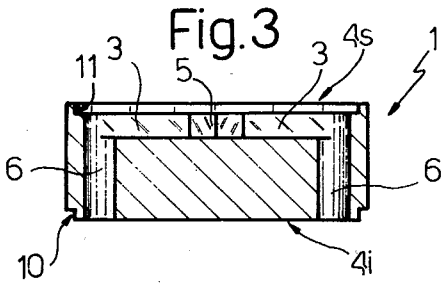
FIGS. 2 and 3 are, respectively, a plan view and a section along line III—III, of a first superimposable element which is part of the device.
Figure 2:
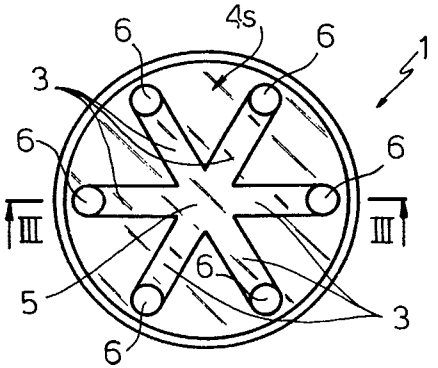
Figure 6:
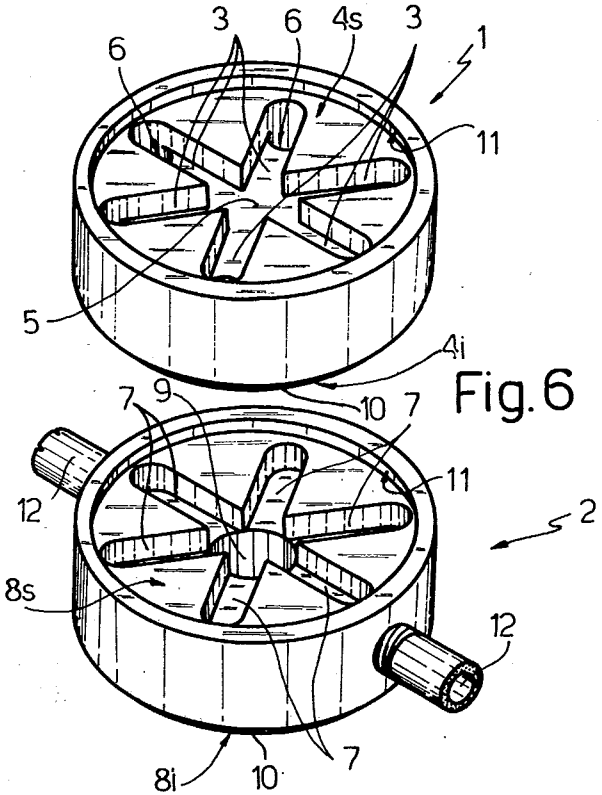
FIG. 6 is a perspective view, in disassembled condition, of the first and second superimposable elements.

In the embodiment shown in the drawings, the said superimposable elements are shaped like cylindrical plates and are of two different types: those of a first type, indicated by reference numeral 1, are shown in plan view and in sectional view in FIGS. 2 and 3 respectively, and those of the second type, indicated by reference numeral 2, are shown in plan view and in sectional view in FIGS. 4 and 5, respectively.

The superimposable elements of the first type comprise substantially a plurality of cavities 3 disposed radially and formed on a corresponding surface 4*s* of the element; each of the said cavities communicates both with a central cavity 5 and a corresponding hole 6 which traverses the said element and whose axis is substantially parallel to the axis of symmetry of the element itself.

The superimposable elements of the second type (FIGS. 4 and 5) are also provided with a plurality of radially extending cavities 7 on the surface 8*s* of the said element, angularly shifted like the cavities 3 of the other element 1, as well as with a central axial hole 9 which traverses the element itself and with which the ends of the cavities 7 communicate.

Figure 1:
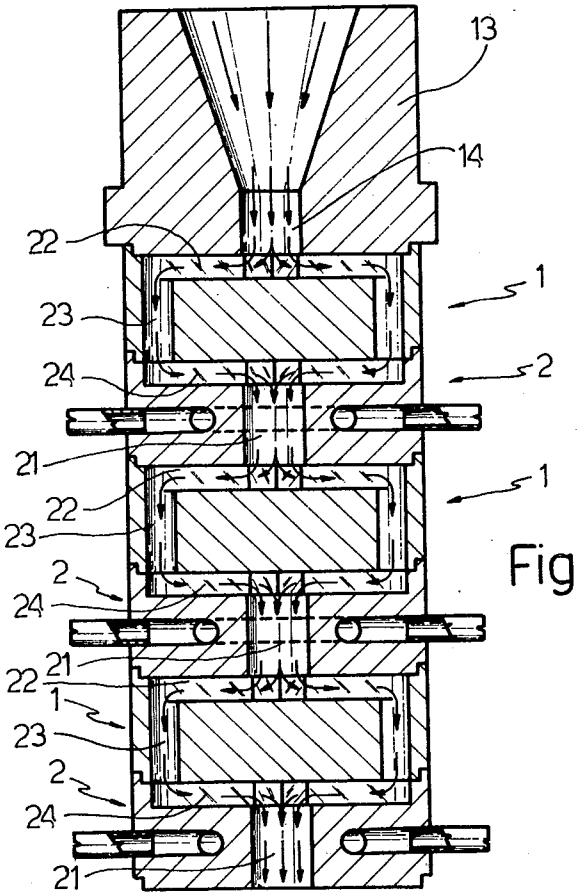
FIG. 1 is a vertical section of the device.

To position in a rigorous manner the elements of the two types 1 and 2 when they are superimposed, as has been shown in FIG. 1, suitable centering means are provided which are arranged to make substantially coincide the axes of two contiguous elements. These means may comprise cylindrical projections 10 and corresponding cavities 11, formed, respectively, on the end surfaces 4*i*, 4*s* of the element 1 and 8*i* and 8*s* of the element 2 and arranged to mate with each other; it is clear, anyway, that also other means may be conceived for positioning and centering the superimposed elements of the two types when they are stacked.

Conveniently, in the elements of the second type 2 there may be formed conduits 12 for the circulation of a cooling (or heating) fluid, which conduits are arranged to be connected to a suitable control circuit for controlling the temperature.

The device according to the present invention further comprises a conveying nosepiece 13 (FIG. 1) which is provided with a central hole 14 whose axis substantially coincides with the axis of the elements 1 and 2 and which is arranged to convey the material to be mixed to the assembly of superposed elements 1 and 2.

The mixer device is assembled by forming a stack with a predetermined number of elements of the two types disposed alternatively. In this way a plurality of channel assemblies are defined which are connected in series to each other; in fact, as can be seen in FIG. 1, three contiguous elements of the stack define an assembly comprising a first axial channel 21 which originates from the corresponding hole 9 of the element 2, a plurality of second radial channels 22 which originate from the cavity 3 of the subsequent element 1 and from the bottom surface 8*i* of the preceding element, a plurality of substantially axial third channels 23, each of which communicates with a corresponding channel 22 and is originated by a hole 6 of the said element 1, as well as a plurality of fourth radial channels 24, each of which communicates with a channel 23 and is originated by a cavity 7 of the successive element 2 and by a bottom surface 4*i* of the preceding element.

The device described hereinabove operates as follows.

A material to be mixed, in the liquid or semiliquid state and comprising a plurality of components, is supplied through the hole 14 of the nosepiece 13. The said components may be of any kind, provided they are in a physical state which allows them to move through the assembly of channels described hereinabove, when they are supplied under pressure through the hole 14 of the nosepiece 13; thus, the components may be those which are utilized in the industry of plastic materials (such as fluid polymers), in the chemical industry (such as chemical products of various nature), in the pharmaceutical industry (preparation of pastes and creams of various types), or in the food industry (for the preparation of sauces, homogenized products or the like).

The device described hereinabove has also proved to be particularly suitable for applications in the metallurgical field for the preparation of mixtures comprising a solid phase and a liquid phase of a metal alloy of the type of those which are utilized in the forming processes referred to as "semiliquid forming processes".

The components to be mixed are first conveyed as a single axial flow generated by the first channel 21 (or by the hole 14 of the nosepiece 13); this flow is then divided into a plurality of flows which move, first, radially towards the outside (in the second channels 22), then axially (in the third channels 23) and finally, still in a radial direction, towards the inside (in the fourth channels 24); then, the thus obtained flows are joined together again to give rise to a successive mixing cycle.

When the various flows come together again at the end of each mixing cycle, coming from the fourth channels 24 to converge in the first channel 21 of the successive assembly of channels, there is obtained a movement which gives rise to a very intense mixing action. This action is due both to the high speed of the flows which converge in a star-like manner through the fourth channels 24 in a very narrow zone which is that of the mouth of the first channel 21, and to the sudden variation of the direction and the speeds which takes place at the passage between the said fourth channels and the said first channel.

In fact, it has been found that a good mixing of the components is obtained already with few mixing stages, even with only three mixing stages.

Moreover, the device according to the present invention lends itself to be immediately adapted to different conditions of mixing, which conditions may be varied both as a function of the nature of components to be mixed, and in view of obtaining different final results. In fact, the addition or the elimination of a predetermined number of elements of the two types 1 and 2 may be carried out in a considerably simple and quick manner.

In addition, the cleaning of the various elements may be carried out thoroughly and without difficulties, because some of the channels of the assembly (channels 22 and 24) are generated by open cavities (cavities 3 and 7) and therefore are easily accessible. Any eventual damage or an excessive wear of one or more elements of the device may be remedied easily and quickly; in fact, to this end it is sufficient to substitute these elements by separating them from the adjacent elements; this operation requires only to axially displace the elements situated abovethe element which has to be substituted and this latter with respect to the other elements, in order to disengage the cylindrical projections 10 from the corresponding cavities 11.

Finally, in the material which moves along the device it is possible to create any thermal gradient whatever by supplying through the conduits 12 into the elements 2 a fluid at a predetermined temperature. This control of the temperature of the material may result in being particularly advantageous in the case of the formation of a mixture comprising a solid phase and a liquid phase of a metal alloy; in fact, it is well-known that the ratio between the concentrations of the said two phases in the mixture depends on the temperature of the mixture, and therefore it may be suitable to vary this temperature with the mixing degree of the mixture.

As long as the material to be mixed which moves in the channels of the device has not reached a service condition of operation, the temperature of the fluid which is supplied into the conduits 12 may be varied; for example, in the case of a metal alloy of the type specified hereinabove it may be suitable to heat the alloy at the beginning of the treatment and successively cool it.

It is clear that modifications and variations may be made to the device described hereinabove, without departing from the scope of the invention. Eash assembly formed by the first channel 21, the second channels 22, the third channels 23 and the fourth channels 24, which are, respectively, radial, axial and radial again, may be realized in a manner different from the manner which has been described hereinabove, by forming on superimposable elements, of any configuration, cavities and holes disposed in accordance with configurations which are able to give rise to the assembly itself when the said elements are superimposed on each other.

I claim:

1. A mixer device arranged to homogeneously mix two or more components in liquid or semiliquid state, particularly the components of a mixture comprising a solid phase and a liquid phase of a metal alloy, characterized in comprising a plurality of superimposable elements, in each of which there are formed cavities and holes arranged to give rise to channels for conveying the said components, the said channel being disposed in such a manner as to originate a plurality of channel assemblies disposed in series to each other, each assembly comprising a first central channel, second channels whose axes are substantially orthogonal to that of the said first channel and which communicate with the said first channel and are disposed radially relative to it, third channels each of which has its axis parallel to that of the said first channel and originates from a corresponding second channel, and fourth channels whose axes are substantially orthogonal to the axis of the said first channel and which are disposed radially with respect to it, each of the said fourth channels being in communication with one of the said third channels and with the first channel of an adjacent assembly.

2. A device as claimed in claim 1, characterized in that the said superimposable elements are of two different types, in elements of a first type there being formed the said second and third channels and in the elements of a second type there being formed the said fourth channels and the said first channel.

3. A device as claimed in claim 2, characterized in that each of the said superimposable elements is plate-shaped, the said first type elements comprising a plurality of cavities formed on a surface of the said plate in a substantially radial arrangement, and a plurality of holes arranged to traverse the said plate and each of which communicates with one of the said cavities, the said cavities and the said holes being arranged to generate the said second and third channels, respectively.

4. A device as claimed in claim 2, characterized in that the said elements of the second type comprise a plurality of cavites formed on a surface of the said plate in a substantially radial arrangement and a central hole arranged to traverse the said plate and communicating with the said cavity, the said cavities and the said hole being arranged to generate the said fourth channels and the said first channel, respectively.

5. A device as claimed in claim 4, characterized in that the said superimposable elements are cylindrical plate-shaped, on each of the said first type elements there being formed a cylindrical projection arranged to engage a corresponding cylindrical cavity of a second type element in order to center one element with respect to another.

6. A device as claimed in claim 1, characterized in that in at least one of the said superimposable elements there are formed conduits for the circulation of a cooling fluid.

* * * * *